US008257514B2

(12) United States Patent
Takayama et al.

(10) Patent No.: US 8,257,514 B2
(45) Date of Patent: Sep. 4, 2012

(54) FERROUS SEAL SLIDING PARTS AND PRODUCING METHOD THEREOF

(75) Inventors: Takemori Takayama, Hirakata (JP); Koji Yamada, Hirakata (JP); Shigeo Otsuka, Hirakata (JP)

(73) Assignee: Komatsu Ltd., Tokyo (JP)

( * ) Notice: Subject to any disclaimer, the term of this patent is extended or adjusted under 35 U.S.C. 154(b) by 132 days.

(21) Appl. No.: 11/071,469

(22) Filed: Mar. 4, 2005

(65) Prior Publication Data

US 2005/0194071 A1 Sep. 8, 2005

(30) Foreign Application Priority Data

Mar. 8, 2004 (JP) ..... 2004-063751
Feb. 4, 2005 (JP) ..... 2005-028516

(51) Int. Cl.
*C22C 37/04* (2006.01)

(52) U.S. Cl. ..... 148/539; 148/543

(58) Field of Classification Search ..... 148/539, 148/543

See application file for complete search history.

(56) References Cited

U.S. PATENT DOCUMENTS 2,973,564 A * 3/1961 Gittus et al. ..... 164/501
3,518,128 A 6/1970 Takao et al.
5,082,433 A * 1/1992 Leithner ..... 419/11
5,305,522 A 4/1994 Nawata et al.
5,478,523 A * 12/1995 Brusso et al. ..... 420/99
6,413,328 B2 * 7/2002 Takayama et al. ..... 148/319

FOREIGN PATENT DOCUMENTS

EP 950723 A1 * 10/1999
JP 51-59007 5/1976
JP 60247037 * 12/1985

OTHER PUBLICATIONS

Abstract of JP60247037.*

* cited by examiner

*Primary Examiner* — Jie Yang
(74) *Attorney, Agent, or Firm* — Wenderoth, Lind & Ponack, L.L.P.

(57) ABSTRACT

A ferrous seal sliding part excellent in heat crack resistance, seizing resistance and abrasion resistance is provided. The ferrous seal sliding part having a seal sliding surface, wherein the seal sliding surface has a martensite parent phase which forms a solid solution with carbon of 0.15 to 0.6 wt % and contains a first dispersion material of at least either cementite of 5 to 70% by volume or MC-type carbide of 0.1 to 10% by volume and a second dispersion material of at least either graphite of 1 to 15% by volume or Cu alloy phase of 1 to 20% by volume dispersed therein, with a total content of the first dispersion material and the second dispersion material being 5 to 70% by volume.

16 Claims, 6 Drawing Sheets
(1 of 6 Drawing Sheet(s) Filed in Color)

GRAPHITE FLAKE

SPHEROIDAL GRAPHITE

VERMICULAR GRAPHITE

BLACK HEART MELLEABLE CAST IRON

FERROUS SEAL SLIDING PARTS AND PRODUCING METHOD THEREOF

FIELD OF THE INVENTION

The present invention relates to ferrous seal sliding parts available for floating seal members such as rollers, idlers and reduction gears for construction machines and a producing method thereof.

BACKGROUND OF THE INVENTION

A track roller assembly and a reduction gear apparatus of a construction machine are equipped with ferrous floating seal parts for the purpose of preventing leakage of lubrication oil from inside thereof as well as entering of earth and sand therein. Accordingly, such floating seal parts are widely produced by applying adequate treatment in which a seal sliding surface thereof is quenched to have a hard martensite structure, or a large amount of hard cementite and $Cr_7C_3$ carbide of 30% by volume are crystallized in the seal sliding surface while causing a parent phase to a martensite by quenching, in order to improve seizing resistance and abrasion resistance. Such an exemplary floating seal part is made by using a Ni-hard cast iron (having a typical composition of carbon of 2.7 to 3.5 wt %, Si of 0.4 to 1.0 wt %, Mn of 0.4 to 0.6 wt %, Ni of 4.2 to 4.7 wt % and Cr of 1.4 to 2.5 wt %), a high-carbon and high-Cr cast iron (for example, carbon of 3.3 to 3.6 wt %, Cr of 15 to 17 wt %, Mo of 2.5 to 3.5 wt % and V of 0.2 to 0.5 wt %) (for example, as shown in Japanese Patent Publication (KOKAI) No. S51-59007).

In addition, a ferrous floating seal part in which cladding abrasion-resistant material containing of WC and self-fluxing alloy is splayed to a seal sliding surface thereof is sometime used for some purposes.

In the ferrous floating seal part used for sealing a lubricating oil in the reduction gears and the track rollers, a seal sliding surface thereof is abraded as fine particles of earth and sand are entered on the seal sliding surface by hulling motion in the earth and sand, and is lubed with the sealed lubrication oil therein. Accordingly, a ferrous floating seal part capable of withstanding a very severe lubrication condition is required. Even in a case of a most conventionally used hard ferrous floating seal part made of a high-carbon and high-Cr cast iron, when setting pressure (press force) at assembling is high, considerable quenching crack (heat crack), seizing and abnormal abrasion occur on the seal sliding surface, resulting in leakage of oil.

And, even if various tool steels such as a cold work tool steel and a high speed steel (SKH material) are applied so as to increase the seizing resistance and the abrasion resistance, seizing due to defect of seizing resistance easily occurs, resulting in insufficient heat crack resistance and abrasion resistance. In addition, since such steels are so expensive that a material costs would increase in view of material yields before a product is finished.

Further more, in resent years, construction machines such as bulldozer are required to be driven at a high speed for improvement in working efficiency, and therefore, the ferrous floating seal part necessarily rotates at a high speed. This also causes quenching crack, seizing and abnormal abrasion, resulting in leakage of oil.

In order to solve the above-mentioned problem, an object of the present invention is to provide ferrous seal sliding parts excellent in heat crack resistance, seizing resistance and abrasion resistance and a producing method thereof.

SUMMARY OF THE INVENTION

Accordingly, an object of the present invention is to provide a ferrous seal sliding part having a seal sliding surface, wherein the seal sliding surface has a martensite parent phase which forms a solid solution with carbon of 0.15 to 0.6 wt % and contains a first dispersion material of at least either cementite of 5 to 70% by volume or MC-type carbide of 0.1 to 10% by volume and a second dispersion material of at least either graphite of 1 to 15% by volume or Cu alloy phase of 1 to 20% by volume dispersed therein, with a total content of the first dispersion material and the second dispersion material being 5 to 70% by volume.

A ferrous seal sliding part according to the present invention has a seal sliding surface, wherein the seal sliding surface is formed by using a cast iron containing carbon of 2 to 5 wt %, Si of 0.5 to 6 wt %, Cr of 0.3 to 5 wt % and one or more alloy element selected from the group consisting of Al, Mn, Ni, Cu, Co, Mo, W, V, Ti, Zr, Nb, Ta, P, B, Ca and S.

In the present invention, it is also possible that the ferrous seal sliding part is made by casting using the aforesaid cast iron.

And, it is also possible that the ferrous seal sliding part is a floating seal part made by casting using the aforesaid cast iron.

A producing method of a ferrous seal sliding part according to the present invention comprises a step for casting a cast iron containing carbon of 2 to 5 wt %, Si of 0.5 to 6 wt %, Cr of 0.3 to 5 wt % and one or more alloy element selected from the group consisting of Al, Mn, Ni, Cu, Co, Mo, W, V, Ti, Zr, Nb, Ta, P, B, Ca and S, wherein the seal sliding part has a martensite parent phase which forms a solid solution with carbon of 0.15 to 0.6 wt % and contains a first dispersion material of at least either cementite of 5 to 70% by volume or MC-type carbide of 0.1 to 10% by volume and a second dispersion material of at least either graphite of 1 to 15% by volume or Cu alloy phase of 1 to 20% by volume dispersed therein, with a total content of the first dispersion material and the second dispersion material being 5 to 70% by volume.

EFFECT OF THE INVENTION

As described above, the present invention will provide ferrous seal sliding parts excellent in heat crack resistance, seizing resistance and abrasion resistance and a producing method thereof.

BRIEF DESCRIPTION OF THE DRAWINGS

The patent or application filed contains at least one drawing executed in color. Copies of this patent or patent application publication with color drawing(s) will be provided by the Office upon request and payment of the necessary fee.

DETAILED DESCRIPTION OF EMBODIMENT OF THE INVENTION

Figure 1:
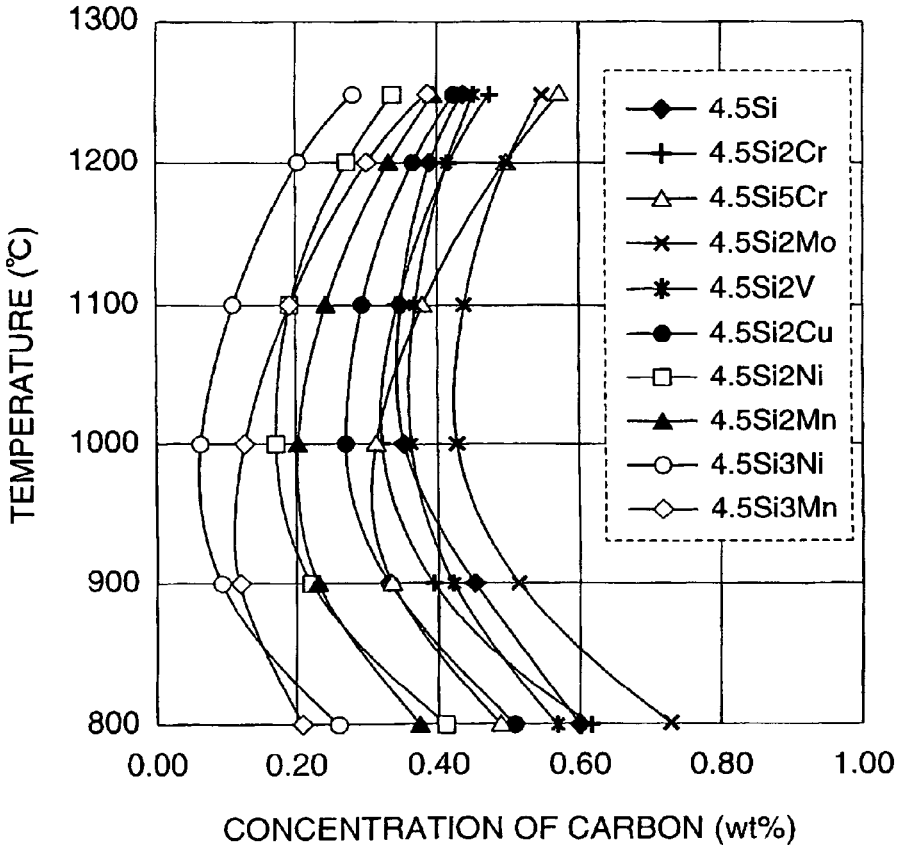
FIG. 1 is a drawing showing a thermodynamically calculated phase diagram of a mixture of ferrite and austenite and an austenite phase of a material containing iron, Si of 4.5 wt %, carbon and M (alloy element).

The present invention is to provide a cast iron sliding material having the following properties, which is used for a floating seal part.

(1) Hard cementite, having small scraping characteristics against the counterpart surface to a sliding surface and high toughness, is dispersed in a martensite parent phase in 5 to 70% by volume so as to improve adhesion resistance and abrasion resistance.

(2) At least either graphite or Cu alloy phase, excellent in adhesion resistance and capability for supplying an lubricating oil to a seal sliding surface (oil pocket forming capability), is dispersed and precipitated in 1 to 20% by volume so as to improve lubricating property of the seal sliding surface, therefore to improve seizing resistance.

(3) In order to improve heat crack resistance of a martensite parent phase, a concentration of carbon in the martensite parent phase is adjusted as small as to 0.15 to 0.6 wt %.

(4) In order to increase tempering-softening resistance of martensite and to adjust an amount of retained austenite improving conformability, an alloy element such as Si, Al, Ni, V, Mo and W should be suitably added.

(5) MC-type carbide of V, Ti, Zr, Nb, Ta and the like is dispersed so as to improve adhesion resistance and abrasion resistance.

A floating seal part, which is an exemplary ferrous seal sliding part according to the present invention, requires higher heat crack resistance, seizing resistance and abrasion resistance withstanding a severe use condition. A floating seal part according to the present invention is made by a ferrous seal sliding material having a martensite phase which forms a solid solution with carbon of 0.15 to 0.6 wt % to improve heat crack resistance and contains at least either cementite of 5 to 70% by volume or MC-type carbide of 0.1 to 10% by volume dispersed therein to improve seizing resistance and abrasion resistance and at least either graphite of 1 to 15% by volume or Cu alloy phase of 1 to 20% by volume dispersed therein to improve seizing resistance, with a total content of at least either the cementite or the MC-type carbide and at least either the graphite or the Cu alloy phase being 5 to 70% by volume.

The ferrous seal sliding material employs a cast iron containing carbon of at least 2 to 5 wt %, Si of 0.5 to 6 wt %, Cr of 0.3 to 5 wt % and one or more alloy element selected from the group consisting of Al, Mn, Ni, Cu, Co, Mo, W, V, Ti, Zr, Nb, Ta, P, B, Ca and S.

In the present invention, in order to improve heat crack resistance, a sliding surface of a floating seal part is made to have a martensite parent phase containing carbon of 0.15 to 0.6 wt %. Because, it is supposed that a ferrous floating seal part made of the aforesaid high-carbon and high-Cr cast iron has a martensite phase containing carbon of about 0.8 wt %, and therefore, the upper limit of an amount of carbon which forms a solid solution with a martensite phase is preferably set at 0.7 wt %. However, in view of a concentration of carbon contained in a hot work tool steel (SKD6, SKD7, SKD61, SKD62, SKD8 and 3Ni-3Mo steel) which requires high heat crack resistance, it is preferred that the upper limit of an amount of carbon which forms a solid solution with a martensite phase is set at 0.6 wt % and the lower limit thereof is set at 0.15 wt %.

In addition, in order to further improve abrasion resistance to entering of earth and sand, it is preferable that the martensite parent phase has hardness of Hv500 or more. And, in order to ensure more stable heat crack resistance, it is more preferable that a concentration of carbon which forms a solid solution with the martensite parent phase is adjusted to within the range of 0.15 to 0.5 wt %.

Next, a method for adjusting a concentration of carbon, which forms a solid solution with a quench hardened martensite parent phase to the aforesaid range, will be explained. In order to cause a matrix of a cast iron to have a stable pearlite structure, it is preferable that Cr of 0.3 wt % or more is contained.

(Method 1) When a cast iron to be a pearlite structure is quenched during casting, a concentration of Si in an austenite phase (a martensite phase after quenching) is adjusted to 2 wt % or more, and preferably 3 wt % or more, by using the following method. That is, a eutectoid carbon concentration of a pearlite structure containing iron and carbon is about 0.8 wt %, and the concentration may decrease by addition of Si, remarkably increasing carbon activity in an austenite phase, at a ratio of an amount of carbon of 0.1 wt % per an amount of Si of 1 wt %.

Si hardly forms a solid solution with graphite, cementite and MC-type carbide but almost all Si is concentrated in a martensite phase. Accordingly, for example, in a cast iron in which cementite is dispersed in 40% by volume, in order to obtain a martensite phase containing Si of 3 wt %, Si of 1.8 wt % may be added to the cast iron. And, when a total content of cementite and graphite is a preferable lower limit of 16% by volume, as described later, in order to adjust a concentration of carbon which forms a solid solution with a martensite parent phase to within the range of 0.15 to 0.6 wt %, Si of 1.5 to 6 wt % may be added to the cast iron. And, since Cr has substantially the same capability to decrease a eutectoid carbon concentration as Si, it is preferable that a total amount of Si and Cr in a martensite parent phase is adjusted to 2 wt % or more, and preferably 3 to 6.5 wt %. Therefore, in the present invention, it is preferable that a cast iron contains Si of at least 1.8 to 6 wt % so that a concentration of Si in a martensite parent phase will be adjusted to 3 to 6.5 wt %. The upper limit of an amount of Si added to the cast iron is set at 6 wt % for the purpose of toughness.

Another method for adjusting a concentration of carbon which forms a solid solution with a martensite parent phase to the aforesaid range will be explained.

(Method 2) In a case of a cast iron in which graphite and ferrite phase are precipitated, it is preferable that the cast iron is heated to A1 transformation temperature or more, whereby carbon in the graphite is diffused in and forms a solid solution with austenite, and then directly quenched after a heat treatment for causing the ferrite phase to be disappeared.

(Method 3) After the heating treatment of the method 2, the cast iron is cooled down to cause a parent phase to have a pearlite structure or a structure in which granulated cementite is dispersed, and then quenched.

At this time, the quenching treatment is preferably carried out such that the cast iron is induction heated at only a sliding surface thereof at a heating rate of 150° C./sec or more to cause pearlitely platy cementite or granulated cementite to remain in a martensite parent phase without forming a solid solution therewith. In such a case, a concentration of carbon which forms a solid solution with the martensite phase can be adjusted depending on a concentration of Cr in cementite. Accordingly, adjusting a concentration of Cr in cementite to 4 to 15 wt % will allow a concentration of carbon which forms a solid solution with the martensite phase to 0.15 to 0.6 wt %.

And, the concentration of the carbon decreases depending on a concentration of Si in austenite at a rate of an amount of carbon of 0.1 wt % per an amount of Si of 1 wt %. For example, when Si of 4 wt % is contained, Cr of 2.5 wt % may be contained in cementite. So, a range of concentration of Cr in cementite is preferably 2.5 to 15 wt %. Accordingly, in the present invention, it is preferable that a cast iron contains at least Si of 0.5 to 1.5 wt % and Cr of 0.9 to 5 wt % so that a total amount of Si and Cr in a martensite parent phase will be adjusted to 2 to 4 wt % and an amount of Cr in cementite will be adjusted to 2.5 to 15 wt %.

In addition, a structure, in which cementite in addition to cementite crystallized in a martensite phase by a eutectic reaction, are finely and pearlitely dispersed in a martensite parent phase, enhances capability for supplying a lubricating oil to a sliding surface of a floating seal part and also enhances abrasion resistance of a parent phase. Accordingly, such the structure is preferable for a ferrous seal sliding material according to the present invention.

When a martensite phase contains Si of 4 wt % or more, as calculated from a HANSEN'S phase diagram of iron and Si, a $Fe_3Si$ order-disorder transformation is demonstrated so that tempering-softening resistance and adhesion resistance of a sliding surface will be significantly improved. However, when a martensite phase contains Si of 7 wt % or more, ordered phases appear, causing remarkable brittleness. Accordingly, it is preferred that a concentration of Si in a martensite parent phase is adjusted to 4 to 6.5 wt %, and it is more preferred that a concentration of carbon which forms a solid solution with the martensite parent phase is adjusted within the range of 0.15 to 0.4 wt %.

As described later, an alloy element demonstrating the order-disorder transformation includes Al which has little solid solubility with cementite, as well as Si. Therefore, in the present invention, an addition of Al is preferred. However, Al has a little capability to decrease a concentration of carbon which forms a solid solution with a martensite phase. Accordingly, it is preferable that a solid soluble concentration of carbon with a martensite parent phase is adjusted by adjusting an amount of Si contained in the martensite parent phase and the order-disorder transformation is demonstrated by adding of Al with Si. This prevents brittleness and improves seizing resistance and abrasion resistance.

In the present invention, it is preferable that the cast iron contains Al of 0.5 to 6 wt % so that a concentration of Al in a martensite parent phase will be adjusted to 1 to 12 wt %.

Si in a martensite phase is a typical element to increase tempering-softening resistance, and especially increases tempering-softening resistance higher than Mo and W in a low temperature region under 450° C.; however, smaller than Mo and W in a high temperature region over 450° C. Accordingly, it is preferable to make an alloy element, such as Mo and W, positively form a solid solution. In a case of addition of Mo and W coexistent with Si, when Mo of less than a highest effective addition amount of 2.3-0.5×an amount of Si (wt %) is added, softening-tempering resistance of Mo can be efficiently demonstrated. And, a distribution coefficient γKMo of Mo between cementite and austenite, which are crystallized during solidification, is shown by dividing a concentration (wt %) of Mo in the cementite by a concentration (wt %) of Mo in the austenite. The γKMo of Mo is 2 to 2.5, and a maximum solid solubility limit of Mo with cementite is about 2 wt %, at which a concentration Mo in a martensite parent phase is about 1 wt %. Therefore, in a ferrous seal sliding material according to the present invention, it is preferable that a cast iron contains Si of 1 to 3 wt % and Mo and W in a total amount of 0.5 to 2 wt % so that in a martensite parent phase an amount of Si will be adjusted to 2 to 4 wt % and a total amount of Mo and W will be adjusted to 0.5 to 1 wt %. And, in order to enhance tempering-softening resistance in a low temperature region and further enhance it in a high temperature region, it is preferable that Mo of 0.5 to 2 wt % is added to the cast iron so that an amount of Mo in a martensite parent phase can be adjusted to 0.3 to 1 wt %. And, since W has a distribution coefficient γKW of about 1.5 and a maximum solid solubility limit with cementite is 2 wt %, as the result of the same study as Mo, W works efficiently more than or equal to Mo. Accordingly, in the present invention, it is preferred that Mo and W in a total amount of 0.5 to 2 wt % is added to the cast iron. The upper limit of a total addition amount of Mo and W is determined such that $Fe_3Mo_3C_6$-type special carbide is precipitated in a small amount and Mo and W of a largest amount capable of coexisting with cementite form a solid solution with a martensite parent phase. An addition of Mo and W in an amount larger than the upper limit is not preferable from an economical viewpoint. Since Mo special carbide ($Fe_3Mo_3C$) is used as a material for a conventional high-carbon and high-CrMo floating seal part, seizing resistance and abrasion resistance will not decline.

An element to increase a carbon activity in an austenite phase so as to decrease a solid soluble concentration of carbon with austenite includes P, in addition to Si. P, however, has a solid solubility limit with austenite of under 1 wt %, whereby capability to decrease a solid soluble concentration of carbon is small. But, since precipitated $Fe_3P$ phosphide improves seizing resistance of a sliding surface, it is preferred that P of 1.5 wt % or less, at which the cast iron is not embrittled so much, is added.

The present invention proposes dispersion of MC-type carbide of 0.1 to 10% by volume, as described above. So, a dispersion of very hard MC-type carbide, excellent in adhesion resistance, of 0.1% or more by volume significantly improves adhesion resistance as well as seizing resistance of a sliding surface (refer to hard particles dispersion effect). On the other hand, since a high speed steel in which $V_4C_3$ is dispersed in about 10% by volume improves abrasion resistance to earth and sand, it is preferable that an upper limit of addition amount of MC-type carbide is 10% by volume from an economical viewpoint for precipitating MC-type carbide. Accordingly, a cast iron abrasion resistant sliding material in which MC-type carbide and at least either graphite or Cu alloy phase, which improve lubricating property of a sliding surface, are dispersed in a martensite parent phase is suitable for a floating seal part. In order to more increase abrasion resistance to earth and sand, it is preferable that a content of MC-type carbide is adjusted to 2 to 10% by volume.

In a cast iron used for a floating seal part which requires abrasion resistance to entering of earth and sand, it is preferable that a largest amount of hard carbide is dispersed. Accordingly, the present invention proposes dispersion of inexpensive cementite of 5 to 70% by volume. The reason that the lower limit of a content of cementite is set at 5% by volume is, for example, that a high speed steel extremely excellent in abrasion resistance has carbide, of which a content is adjusted to 5 to 17% by volume after quenching. Furthermore, in order to improve seizing resistance and abrasion resistance capable of withstanding a severe oil sliding condition, demonstrating a lot more hard particles dispersion effect will be effective. Especially, when abrasion resistance is important factor, it is preferable that the lower limit thereof is 15% by volume in view of the aforesaid high speed steel. Accordingly, mixing the cementite with the MC-type carbide improves the seizing resistance and the abrasion resistance more effective. Furthermore, dispersing at least either graphite or Cu alloy phase improves seizing resistance and adhesion resistance. In addition, it is preferable that Cu alloy phase is dispersed in the martensite parent phase in 1 to 10% by volume.

In order to enhance abrasion resistance to entering of earth and sand and seizing resistance, it is effective to disperse cementite in a larger amount. Accordingly, in the present invention, the upper limit of a content of cementite is set at 70% by volume, and, more preferably 50% by volume, because a ferrous floating seal part made of the high-carbon and high-Cr cast iron containing carbide dispersed therein in 50% or more by volume becomes brittles excessively.

Accordingly, it is preferable that an amount of carbon added to the cast iron should be 2 to 5 wt % in view of the lower and upper limits of the cementite. When the addition amount of carbon exceeds 4 wt %, very coarse primary cementite will be crystallized in a large amount, resulting in becoming brittles. Accordingly, it is preferable that the added carbon is partially precipitated as graphite and dispersed. Thus, it is preferable that granulated graphite having an average grain size of 15 μm or less, is dispersed in a martensite parent phase in 1 to 10% by volume.

In a cast iron abrasion resistant sliding material according to the present invention, Si is added in a high density. Since Si is a graphitization element, when the material is solidificated at a conventional cooling rate, the material is changed in the structure depending on an addition amount of Si according to a relation of Maurer's cast iron structure diagram. For example, when an addition amount of Si is smaller than 0.6×(4.3−an addition amount of carbon (wt %)), the structure is changed to have a structure of a white cast iron. When an addition amount of Si is larger than 0.6×(4.3−an addition amount of carbon (wt %)), the structure is changed to have a structure in which graphite is dispersed in a pearlite parent phase. And, when an addition amount of Si is equal to or larger than 1.65×(4.3−an addition amount of carbon (wt %)), the structure is changed to have a structure in which graphite is dispersed in a ferrite parent phase. It becomes difficult to disperse eutectic cementite in a cast iron according to the present invention, to which a larger amount of Si is added, as described above. Accordingly, in order to stabilize the eutectic cementite, it is preferable that Cr of 0.9 wt % or more is added so that the cementite will be likely to be graphitized by graphitization. At this time, it is preferable that Cr within the range of 0.9 to 3.5 wt % is added so that an amount of Cr in the cementite will be within the range of 2.5 to 6 wt %. On the other hand, a distribution coefficient γKCr of Cr between cementite and austenite, which are crystallized during solidification, is shown by dividing a concentration (wt %) of Cr in the cementite by a concentration (wt %) of Cr in the austenite. Cr has a distribution coefficient γKCr of about 4. Thus, when cementite of the lower limit of 15% by volume is dispersed, the lower limit of an amount of Cr added to the cast iron is calculated as 0.9 wt %. When a concentration of Cr in cementite exceeds 10 wt %, graphitization will not precede, even if processing time is lengthened. Accordingly, as described later, in the abrasion resistant sliding material in which a suitable amount of graphite is dispersed by graphitization in a short period, it is preferable from an economical viewpoint that the upper limit of an addition amount of Cr is set at 3.5 wt % so that a concentration of Cr in cementite will be 6 wt %.

Mn is an element which stabilizes cementite so as to suppress graphitization of the cementite, and it is not prevented that Mn of an amount of 0.1 wt % or more is included in a cast iron. And, an addition of Mn of 5 wt % or more changes the cast iron to a white cast iron. From the result, it is found that a distribution coefficient γKMn of Mn is 1.5 to 2, and that containing Mn of 10 wt % or more allows stabilization of the eutectic cementite. Consequently, although Mn is not expected to have so much capability to stabilize eutectic cementite as Cr, it is still preferable that Mn is positively added. And, as described later, Mn is an element to stabilize austenite significantly as well as Ni, and enhances hardenability so as to form a retained austenite phase. In addition, Mn is inexpensive. Thus, it is preferable that Mn of 0.7 to 5 wt % is positively added. For example, when Mn of 5 wt % is added to a cast iron in which cementite is dispersed in 50% by volume, a concentration of Mn in a martensite parent phase becomes about 3.3 wt %, and as a result, austenite is stabilized so that ferrite formation during solidification will be suppressed, and good hardenability, in addition to a suitable amount of retained austenite formation, will be achieved.

A content F (% by volume) of retained austenite in a martensite parent phase is experientially calculated by using Ms temperature (martensite transformation temperature) of the martensite parent phase and a following equation (d).

$$F=100\exp(-0.011\times(Ms-Q)) \quad \text{(d)}$$

In turn, the Ms temperature is calculated by using a composition of the martensite parent phase and a following approximate equation (e).

$$\text{Ms(K)}=993-514\times\text{an amount of carbon(wt \%)}^{1/2}-20\times\text{an amount of Si (wt \%)}+23\times\text{an amount of Al(wt \%)}-46\times\text{an amount of Mn (wt \%)}-30\times\text{an amount of Cr (wt \%)}-21\times\text{an amount of Ni (wt \%)}-9\times\text{an amount of Cu (wt \%)}-20\times\text{an amount of Mo (wt \%)} \quad \text{(e)}$$

Here, Q means a cooling temperature of 303K (Kelvin).

Using those equations makes it easier to adjust an amount of retained austenite.

In the approximate equation (e), an amount of carbon (wt %) means a content of carbon in the martensite parent phase; an amount of Si (wt %) means a content of Si in the martensite parent phase; an amount of Al (wt %) means a content of Al in the martensite parent phase; an amount of Mn (wt %) means a content of Mn in the martensite parent phase; an amount of Cr (wt %) means content of Cr in the martensite parent phase; an amount of Ni (wt %) means a content of Ni in the martensite parent phase; an amount of Cu (wt %) means a content of Cu in the martensite parent phase; and an amount of Mo (wt %) means a content of Mo in the martensite parent phase.

In the present invention, it is preferable that the cast iron contains Mn of 0.7 to 5 wt % so that a concentration of Mn in a martensite parent phase will be 2 to 4 wt %, Ms temperature obtained by the approximate equation (e) will be adjusted to 95 to 260° C., and retained austenite will remain in the martensite parent phase in 10 to 50% by volume.

Ni and Cu each having distribution coefficient γKNi of 0.3 and γKCu of 0 are elements to promote graphitization of cementite. And, they are concentrated in a martensite parent phase more effectively than Mn so as to stabilize austenite remarkably. As a result, hardenability is enhanced and retained austenite is formed. Accordingly, it is preferable that Ni and Cu are positively added. And, Cu of 2 wt % contained in a matrix parent phase has capability to stabilize austenite (described below) and to lower the Ms temperature, correspondent to that of Ni of 1 wt %.

It is apparently effective for improvement in abrasion resistance that harder particles, such as special carbide, nitride and carbonitride, are dispersed. If a larger amount of Cr and Mn is added, Cr and Mn of 36 wt % or more can form a solid solution with cementite. However, if a larger amount of Mo, W, V and Ti are added, Mo of 2 wt %, W of 1.5 wt %, V of 0.6 wt % and Ti of about 0 wt % forms a solid solution with cementite. Since almost all of such alloy elements are precipitated as special carbide and nitride thereof, they hardly work on stabilization of cementite, and therefore cannot prevent graphitization. Accordingly, it is possible that special carbide of Mo, W, V and Ti improving seizing resistance and abrasion resistance are effectively dispersed in the cast iron in which graphite is dispersed. And, it is preferable that an alloy element such as V, Ti, Nb, Zr, Ta and Hf, having good seizing resistance and capable of forming very hard MC-type carbide, of 1 wt % or more, similar to the high speed steel, is added so as to disperse MC-type carbide of 2 to 10 wt %, thereby to improve seizing resistance and abrasion resistance.

In other words, in the present invention, it is preferable that the cast iron contains one or more alloy element selected from the group consisting of V, Ti, Zr, Nb and Ta in a total amount of 1 to 5 wt % so that at least any one of MC-type carbide, nitride and carbonitride of the aforesaid alloy element will be dispersed in a martensite parent phase in 2 to 10% by volume.

When the method (2) and the method (3) for adjusting a solid soluble concentration of carbon with a martensite parent phase are applied, in a case of a cast iron in which at least any one of graphite flake, nodular graphite and vermicular graphite is dispersed in a parent phase of either ferrite or a mixture of ferrite and pearlite at casting process, it is required that the cast iron is heated to A1 transformation temperature or more, thereby to form a solid solution of a part of the graphite so as to have a solid soluble concentration of carbon to the aforesaid concentration, and then quenched. In this case, it is preferable that after heating to A1 temperature or more, once cooled down so as to transform a parent phase to a pearlite structure, and then quenched. In a case of a cast iron in which large eutectic cementite is dispersed in martensite, bainite and pearlite in the casting process, it is preferable that the quenching is carried out after a heat treatment for graphitization, or a heat treatment for concentrating Cr and the like in cementite. The quenching is preferably carried out such that a sliding surface is quenched by the aforesaid rapid induction heating, and more preferably quenched after heating within the temperature range of A1 transformation temperature to a quenching temperature (900 to 1100° C.) at a heating rate of 150° C./sec or more, preferably 500° C./sec or more. This causes fine cementite, in addition to large crystallized cementite, to disperse in a martensite parent phase without forming a solid solution therewith. A structure in which cementite is pearlitely dispersed in martensite is suitable structure for a cast iron abrasion resistant sliding material because of improvement in lubricating property of lubrication oil of a sliding surface.

The present invention is to provide a ferrous seal sliding part, wherein a cast iron containing carbon of 2 to 5 wt %, Si of 0.5 to 6 wt %, Cr of 0.3 to 5 wt % and one or more alloy element selected from the group consisting of Al, Mn, Ni, Cu, Co, Mo, W, V, Ti, Zr, Nb, Ta, P, B, Ca and S is used so that a martensite parent phase will form a solid solution with carbon of 0.15 to 0.6 wt % and contain a first dispersion material of at least either cementite of 5 to 70% by volume or MC-type carbide of 0.1 to 10% by volume and a second dispersion material of at least either graphite of 1 to 15% by volume or Cu alloy phase of 1 to 20% by volume dispersed therein, with a total content of the first dispersion material and the second dispersion material being 5 to 70% by volume.

The aforesaid graphite includes at least any one of graphite flake, nodular graphite and vermicular graphite, which are formed at solidification process of the cast iron. However, in order to finely and evenly disperse very soft graphite which would work as a solid lubricant, as well as in order to disperse a larger amount of cementite, in the present invention, it is preferable that the graphite is transformed to a white cast iron and then graphitization tempered to form granulated graphite having an average grain size of 15 μm or less. And, regulating a condition of the graphitization tempering condition will cause a large amount (15 to 50% by volume) of cementite to remain while the large eutectic cementite being homogenized and dispersed, thereby to improve in seizing resistance and abrasion resistance.

And, it is preferable that a dispersion content of cementite is 15 to 50% by volume, as described above. On the other hand, a dispersion content of graphite is preferably determined such that the lower limit thereof is 1% by volume at which lubrication property as a solid lubricant and an oil pocket inherent in graphite is obviously demonstrated and the upper limit is 15% by volume, which is a maximum content of graphite in a conventional cast iron, and more preferably 10% by volume, at which the lubricating property is saturated and toughness is obtained. In addition, although the lower limit is determined based on the fact that a sliding material with dispersion of graphite of 1% by volume improves seizing resistance remarkably, it is more preferable that the lower limit of graphite to be dispersed is of 3% or more by volume.

Cu alloy particles are often utilized as a sliding material, because of its excellence in adhesion resistance to a ferrous alloy material. And, because of softness thereof, Cu alloy phase dispersed in a martensite parent phase is abraded slightly by carbide contained in a floating seal material at sliding to form an oil groove, where lubricating oil is received, whereby lubricating property of the sliding surface is improved. Even if a very little heat crack is occurred in a sliding surface, Cu alloy particles work so as to prevent growing of the heat crack. Accordingly, in the present invention, it is preferable that the lower limit of a content of Cu alloy phase dispersed in a martensite parent phase is set at 1% by volume, at which improvement in lubricating property begins to appear. Although a precipitation and a dispersion of the Cu alloy phase does not cause brittleness of a floating seal part, increasing an amount of the Cu alloy phase causes decreasing abrasion resistance of the floating seal part due to its softness, whereby it is preferable that the upper limit of a content of Cu alloy phase dispersed in a martensite parent phase is set at 10% by volume.

A method for forming a martensite parent phase or a martensite parent phase in which cementite is pearlitely dispersed requires a quenching treatment, whereby economical efficiency in manufacturing costs becomes a problem. Accordingly, it is preferable that a cooling rate at casting is raised so as to form a martensite parent phase during the casting process. A case in which a soft ferrite phase is precipitated in a solidification process has a problem that seizing resistance and abrasion resistance are not improved. Especially, Si is a ferrite stabilized element. In a case of a cast iron which has a martensite parent phase (an austenite parent phases at heating) which form a solid solution with carbon of 0.15 to 0.5 wt % and contains concentrated Si of 2 to 6.5 wt %, ferrite should be easily precipitated. Preventing precipitation of ferrite requires an addition of austenite stabilized element. Accordingly, in the present invention, it is preferable that at least one or more Mn, Ni and Cu in a total amount of 2 to 7 wt % are contained in an austenite parent phase.

FIG. 1 is a drawing showing a thermodynamically calculated phase diagram of a mixture of ferrite and austenite and an austenite phase in a material containing iron, Si of 4.5 wt %, carbon and M (alloy element). To obtain an austenite parent phase (a martensite parent phase after quenching) which forms a solid solution with carbon of 0.2 to 0.5 wt %, an addition of austenite stabilized element such as Mn, Ni and Cu works effectively, and this time, it is preferable that an addition amount of each of Mn, Ni and Cu is determined such that as an amount of 0.5×Cu represents half of a real amount of Cu, a total addition amount of Mn, Ni and 0.5×Cu is 2 wt % or more. On the other hand, it is not desirable that a large amount of alloy elements such as Mo, W and V is contained in austenite. When Mo and W of 1 wt % or more forms a solid solution with austenite as described above, Mo special carbide is precipitated whereby an action in which Mo and W cause austenite unstable is restricted. And, since V is precipitated as $V_4C_3$ (MC-type carbide) and hardly forms a solid solution with austenite, a ferrite stabilizing effect is restricted. Accordingly, in the present invention, it is preferable that each amount of Mn, Ni and Cu is determined such that an amount of Mn in a martensite parent phase is set at 2 to 4 wt %, or such that as an amount of 0.5×Cu represents half of a real amount of Cu, a total addition amount of Mn, Ni and 0.5×Cu is within 2 to 7 wt %. And, it is more preferable that Mo and W in a total amount of 1 wt % or less and Ni of 3 wt % or less are contained.

As a larger amount or cementite or MC-type carbide, described later, is dispersed in a martensite parent phase, abrasion resistance to earth and sand for a floating seal part will be improved; however, conformability becomes deteriorating, whereby a seal contact width becomes narrow remarkably, resulting in occurrence of seizing and heat crack caused by heat generation at a seal sliding surface. Accordingly, it is preferable that a cast iron contains at least Mn of 0.7 to 5 wt % so that an amount of Mn in a martensite phase will be adjusted to 2 to 4 wt %, or a cast iron contains at least two of Mn of 0.1 to 5 wt %, Ni of 1 to 2.5 wt % and Cu of 1 to 10 wt % so that as an amount of 0.5×Cu represents half of a real amount of Cu, a total addition amount of Mn, Ni and 0.5×Cu in a martensite parent phase will be adjusted within the range of 2 to 7 wt %. In addition, it is preferable that Ms temperature is adjusted to 95 to 260° C. according to the Ms temperature calculation equation, and retained austenite is contained in a martensite parent phase in 10 to 50% by volume in order to improve conformability and toughness of a sliding surface.

When a graphitizing treatment is utilized to eutectic cementite in a cast iron according to the present invention, it is important to define a relation between a concentration and a degree of graphitization of a graphitizing inhibiting element containing Mn and Mo, other than Cr, and a graphitizing promoting element in the cementite. A concentration CΘM of an alloy element M contained in the cementite is obtained by a following equation using a concentration CM of the alloy element contained in the cast iron, a dispersion amount VΘ (volume fraction) of the cementite and γKM, $$C\Theta M = CM \times \gamma KM / (1 - V\Theta + \gamma KM \times V\Theta)$$

In the present invention, by applying Cr, Mn, Mo and Ni to the alloy element M, the follow equation is obtained.

$$2\text{ wt }\% \leqq C\Theta\text{Cr} + 0.3 \times C\Theta\text{Mn} + 0.3 \times C\Theta\text{Mo} - C\Theta\text{Ni} \leqq 6\text{ wt }\%$$

The lower limit of 2 wt % is determined based on the fact that an addition of Cr of 0.8 wt % will transform a conventional cast iron to a white cast iron which has eutectic cementite containing Cr of about 1.6 wt %. In addition, a coefficient of Mn of 0.3 is determined based on a concentration of Mn contained in cementite in a white cast iron to which the cast iron is transformed by adding Mn of 5 wt %. And, since Mo has substantially the same distribution coefficient as Mn, a coefficient of Mo is set at 0.3, as well as Mn. On the other hand, Ni is a graphitization forming element. When a Ni-Hard cast iron is graphitized at 950° C. for one hour as described later, cementite containing Cr of 5.7 wt % and Ni of 1.91 wt % is graphitized in such a short period. From the result, the upper limit is set at 6 wt % and a coefficient of Ni is set at 1, and the upper limit is more preferably 4 wt %.

Specifically, in a conventional cast iron in which cementite is dispersed in 35% by volume, an addition amount of each alloy element is adjusted so as to satisfy the following equation.

$$2\text{ wt }\% \leqq 0.4 \times C\Theta\text{Mn} + 0.4 \times C\Theta\text{Mo} + 2.0 \times C\Theta\text{Cr} - 0.4 \times C\Theta\text{Ni} \leqq 5\text{ wt }\%$$

A half or more amount of retained austenite is transformed to martensite at sliding, resulting in hardened so as to provide conformability. On the other hand, since other unhardened retained austenite is soft, it is expected to work as the aforesaid oil pocket on a sliding surface. However, a large amount of the soft retained austenite causes decreasing abrasion resistance, whereby it is preferable that an amount of retained austenite should be adjusted to 10 to 40% by volume.

Since heightening tempering-softening resistance of a martensite parent phase demonstrates more efficient abrasion resistant sliding property, it is preferable that Si, Al, Mo, V and W improving tempering-softening resistance significantly are positively added. Especially, Al in a martensite parent phase works to heighten tempering-softening resistance as well as Si, and an addition of Al of 3 wt % or more begins to cause an order-disorder transformation of a $Fe_3Al$ order phase, thereby to improve remarkable seizing resistance. Furthermore, when Al coexists with Ni and Co, remarkable age-hardening appears and as a result, Al is discharged from cementite and concentrated in a martensite parent phase as well as Si. Accordingly, in the present invention, it is preferable that a cast iron contains at least Al of 0.5 to 6 wt % so that an amount of Al in a martensite parent phase will be adjusted to 1 to 12 wt %. And, it is preferable that at least either Ni of 1 to 7 wt % or Co of 2 to 15 wt %, and Al of 1 to 6 wt % are added to the cast iron.

Co increases magnetic transformation remarkably thereby to decrease a distribution coefficient of carbon and an alloy element, resulting in increasing tempering-softening resistance of Mo, V, W, Al, Si and the like. Accordingly, in the present invention, it is preferable that Co of 15 wt % or less is added from an economical viewpoint.

In the present invention, in order to disperse Cu alloy phase in the martensite parent phase in 1 to 10% by volume, it is preferable that Cu of at least 1 to 10 wt % is added to a material used for a casting floating seal. And, in order to increase seizing resistance of Cu alloy phase, it is preferable that a cast iron abrasion resistant sliding material has Cu alloy phase dispersed therein, wherein the Cu alloy phase comprises Cu—Si—Al alloy containing a mixture of Si and Al of 3 to 12 wt %. Alternatively, a β phase or an intermetallic compound phase is preferably dispersed therein.

MC-type carbide is mainly formed by V, W, Ti, Zr, Nb and Ta and is the hardest carbide thereby to contribute to improvement in abrasion resistance. However, the MC-type carbide has little solid solubility with cementite, whereby it hardly stabilizes cementite and does not prevent precipitation of graphite. Accordingly, in a cast iron abrasion resistant sliding material according to the present invention, one or more alloy element selected from the group consisting of V, Ti, Zr, Nb and Ta is added in a total content of 1 to 5% by volume so that one or more MC-type carbide, nitride and carbonitride will be dispersed in a total content of 2 to 10% by volume, whereby abrasion resistance can be improved. For example, in the case of TiC as MC-type carbide, by using a specific gravity of TiC of 4.9 g/cm$^3$, an addition of Ti of 1 to 5 wt % disperses TiC of 2 to 10% by volume, and thus, abrasion resistance is effectively improved. The reason that the upper limit of an addition amount of the alloy elements is 5 wt % is that an amount of MC-type carbide in the aforesaid high speed steel does not exceed about 10% by volume. And, if it exceeds 5% by volume, initial conformability for a floating seal part becomes less efficient.

And, since dispersing phosphide and MC-type carbide in a small amount improves seizing resistance of a sliding surface remarkably, such particles dispersion effect is also expected by dispersing compounds other than the phosphide. Accordingly, in the present invention, it is preferable that phosphide of mainly one or more alloy element of Fe, V and Ti is dispersed in a total content of 0.2 to 5% by volume (more preferably, 1 to 5% by volume), or sulphide of at least either Mn or Ti is dispersed in a total content of 0.2 to 5% by volume (more preferably, 1 to 5% by volume), or the both of the phosphide and the sulphide are dispersed in a total content of 0.2 to 5% by volume (more preferably, 1 to 5% by volume).

In the present invention, it is possible that a floating seal part is formed by casting using the aforesaid ferrous seal sliding material and the aforesaid cast iron abrasion resistant sliding material. And, it is preferable that a ferrous seal sliding part, for example, a floating seal, is formed by casting using the aforesaid cast iron.

And, it is more preferable that the ferrous seal sliding part and the floating seal part are formed by a centrifugal casting method using a quenching chilled cast iron. At this time, it is still more preferable that a mold is heated to the Ms temperature or more of a parent phase of the cast iron and then the centrifugal casting method is applied thereto so as to produce a floating seal part. And, after releasing the floating seal part from the mold at the Ms transformation temperature or more, the floating seal part is quench hardened so as to prevent occurrence of crack and strain at casting.

A producing method of a ferrous seal sliding part according to the present invention comprises a step for casting a cast iron containing carbon of 2 to 5 wt %, Si of 0.5 to 6 wt %, Cr of 0.3 to 5 wt % and one or more alloy element selected from the group consisting of Al, Mn, Ni, Cu, Co, Mo, W, V, Ti, Zr, Nb, Ta, O, B, Ca and S.

It is preferable that the ferrous seal sliding part has a martensite parent phase which forms a solid solution with carbon of 0.15 to 0.6 wt % and contains a first dispersion material of at least either cementite of 5 to 70% by volume or MC-type carbide of 0.1 to 10% by volume and a second dispersion material of at least either graphite of 1 to 15% by volume or Cu alloy phase of 1 to 20% by volume dispersed therein, with a total content of the first dispersion material and the second dispersion material being 5 to 70% by volume.

In the present invention, it is possible that the casting step is for casting the cast iron by a centrifugal method, using a mold which is heated to Ms temperature or more of a parent phase of the cast iron, and quenching the cast iron after releasing from the mold. At this time, it is also preferable that, after the casting step, a step for re-heating the cast iron at A1 transformation temperature or more of the cast iron and then graphitizing is carried out before the quenching step.

Next, a cast iron abrasion resistant sliding material according to the present invention will be described in detail with reference to the accompanying drawings.

Figure 2:
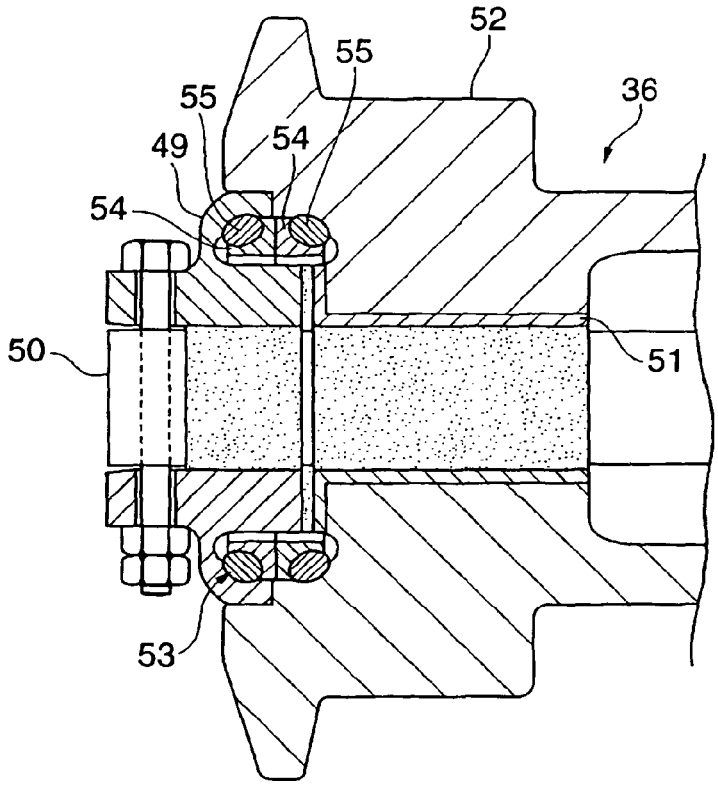
FIG. 2 is a drawing showing a main part of a roller assembly according to one embodiment of the present invention.
Figure 3A:
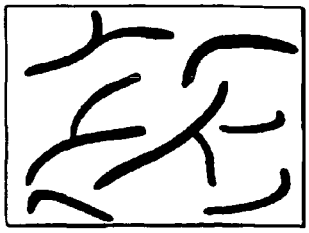
FIG. 3 are drawings showing various structures of graphite crystallized and dispersed in a cast iron formed by casting.
Figure 3B:
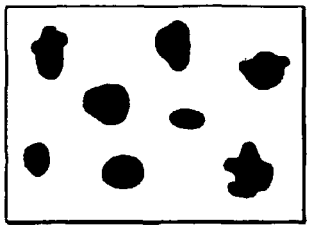
Figure 3C:
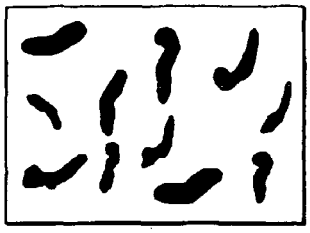
Figure 3D:
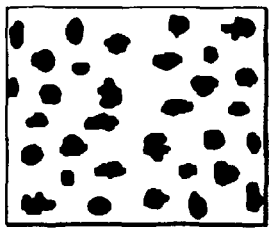

FIG. 2 is a drawing showing a main part of a roller assembly according to one embodiment of the present invention. This embodiment shows a floating seal member equipped with the roller assembly.

The roller assembly 36, according to the embodiment, has a roller retainer 49, a roller shaft 50 supported by the retainer 49 and a roller bush 51 fitted onto the shaft 49, which are rotatably connected each other. A floating seal member 53 is provided with one pair of seal rings 54 with seal surfaces contacted each other and an O-ring 55 fitted onto each of the seal ring 54. In the roller assembly 36, the floating seal member 53 is arranged such that the contacted seal surfaces of the seal rings 54 are pressed toward the roller shaft 50 by elastic force of the compressed O-rings 55. The seal surfaces are relatively slidable while being pressed each other at an adequate pressure so as to prevent entering water or earth and sand from outside, as well as preventing leakage of lubricating oil from inside. The seal surface of the seal rings 54 has a structure which contains at least either cementite of 5 to 70% by volume or MC-type carbide of 1 to 10% by volume and at least either graphite or Cu alloy phase dispersed in a hard martensite parent phase.

In a large diameter floating seal part used for a reduction gear apparatus, a diameter of the seal ring becomes so large that a sliding rate of the seal surface becomes high. Accordingly, a floating seal ring excellent in higher seizing resistance and higher heat crack resistance is required. In order to obtain such floating seal ring, in the present invention, it is preferable that at least either graphite or Cu alloy phase in a total content of 3 to 10% by volume is dispersed in a material for a cast floating seal used at a sliding rate of 1 m/sec or more.

The present invention can provide a floating seal part excellent in seizing resistance and heat crack resistance. In order to further improve heat crack resistance and seizing resistance, it is preferable that an addition amount of an alloy elements such as Si, Cr, Cu, Mo, W and V is regulated so that a solid soluble concentration of carbon with a martensite parent phase will be adjusted to 0.15 to 0.7 wt %, and that rapidly heating quenching, in which a quenching temperature is set at 850 to 1000° C. and a quenching rate is 150° C./sec or more, is carried out. And, it is also preferable that cementite is prepared so as to have a magnetic transformation temperature within the range of 60 to 180° C. by using V, Mn and Cr mainly, and so as to disperse at least either graphite or Cu alloy phase promoting lubricating property, therein. In addition, it is also preferable that an addition amount of each of Si and Cr is adjusted so that a solid soluble concentration of carbon with a martensite parent phase will be 0.15 to 0.6 wt %, that a total amount of Si and Al is heightened up to 4 wt % or more to provide an order-disorder transformation, that MC-type carbide, phosphide and sulphide showing a hard particles dispersion effect are dispersed in a martensite parent phase, and that at least either graphite or Cu alloy phase promoting lubricating property are dispersed in a martensite parent phase. And, it is also preferable that Curie temperature of cementite contained in a cast iron is adjusted to 60 to 150° C. by using V, Mn and Cr so that endothermic phenomenon will appear when a lubricating oil on a sliding surface begins to deteriorate. When a quenching treatment is carried out after graphitizing to disperse graphite, it is preferable to be rapidly heated at a temperature rising rate of 150° C./sec or more to a quenching temperature within the range of 850 to 1050° C. by induction heating capable of rapidly heating, and then cooling, thereby to disperse pearlitely platy cementite and granulated cementite, in addition to eutectic cementite and granulated graphite, in the martensite parent phase.

FIG. 3 are drawings showing various structures of graphite crystallized and dispersed in a cast iron formed by casting. FIG. 3A shows graphite flake, FIG. 3B shows spheroidal graphite, and FIG. 3C shows vermicular graphite. Each of the graphite which appears in a large amount at a solidification process has a parent phase each having a ferrite, acicular ferrite, pearlite, bainaite and martensite structures. The present invention provide a cast iron abrasion resistant sliding material, which is formed such that a cast iron which should have a pearlite structure by addition of Cr of 0.3 wt % or more is rapidly cooled at a solidification process to transform a parent phase to a martensite structure which contains MC-type carbide dispersed therein in 1 to 10% by volume.

Figure 4A:
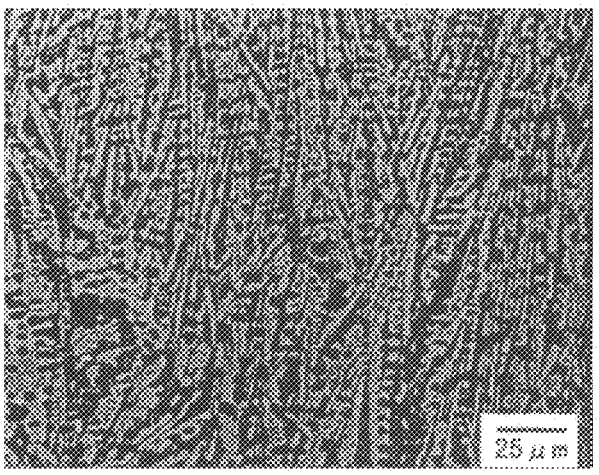
FIG. 4A is a photograph showing a casting structure of Ni-hard comparative material and FIG. 4B is a photograph showing a heat treated structure thereof after graphitizing.
Figure 4B:
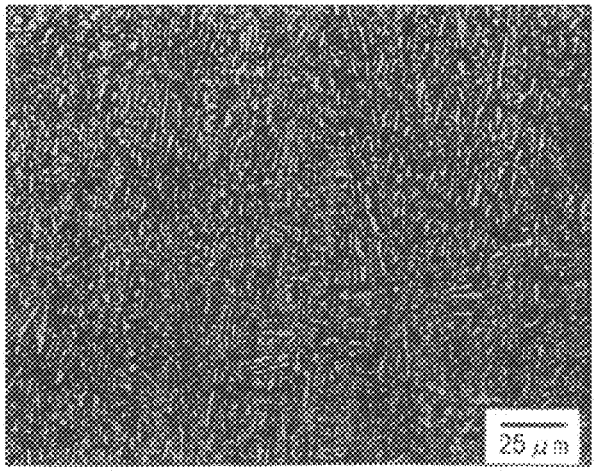

FIG. 4A is a photograph showing a casting structure of a Ni-hard comparative material, in example described later, and FIG. 4B is a photograph showing a heat treated structure thereof after graphitizing. As shown in FIG. 4A, a chilled cast iron has a structure in which a large amount of eutectic cementite is dispersed in a martensite parent phase. And, in a case in which the chilled cast iron is subjected to graphitizing at 950° C. and then directly quenched from such temperature, the original structure is changed to a structure, as shown in FIG. 4B, in which coarse cementite is decomposed to precipitate fine granulated graphite, and as a result, the granulated graphite and uniformly dispersed undecomposed eutectic cementite are dispersed in a martensite parent phase. Such structure is preferable for the purpose of improvement in toughness.

Solid solubility of Cu with a parent phase of a cast iron abrasion resistant sliding material, which varies according to amounts of carbon, Ni and Mn, is about 5 to 6 wt %. Accordingly, by adding Cu of 7 wt % or more, a cast iron having a structure in which Cu alloy phase is granulately dispersed can be obtained. The structures in which Cu alloy phase is dispersed in each of structures, as shown in FIG. 3 and FIG. 4, are therefore included in the category of the present invention.

In order to improve seizing resistance of abrasion resistance of a cast iron abrasion resistant sliding material, it is preferable that carbide such as cementite or $V_4C_3$ is dispersed.

Example

A cast iron abrasion resistant sliding material will be explained with reference to the accompanying drawings.

Figure 5:
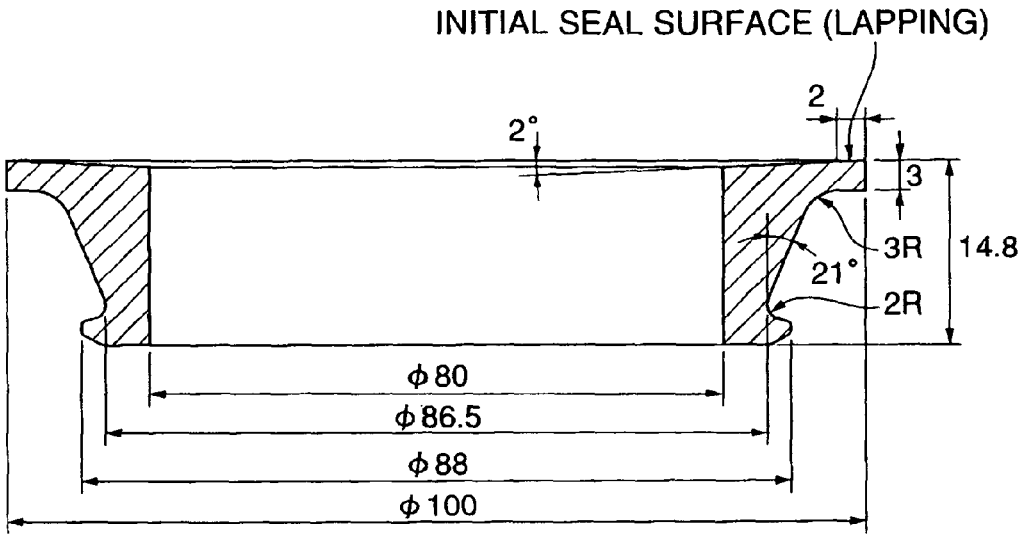
FIG. 5 is a cross sectional drawing showing a floating seal.
Figure 6:
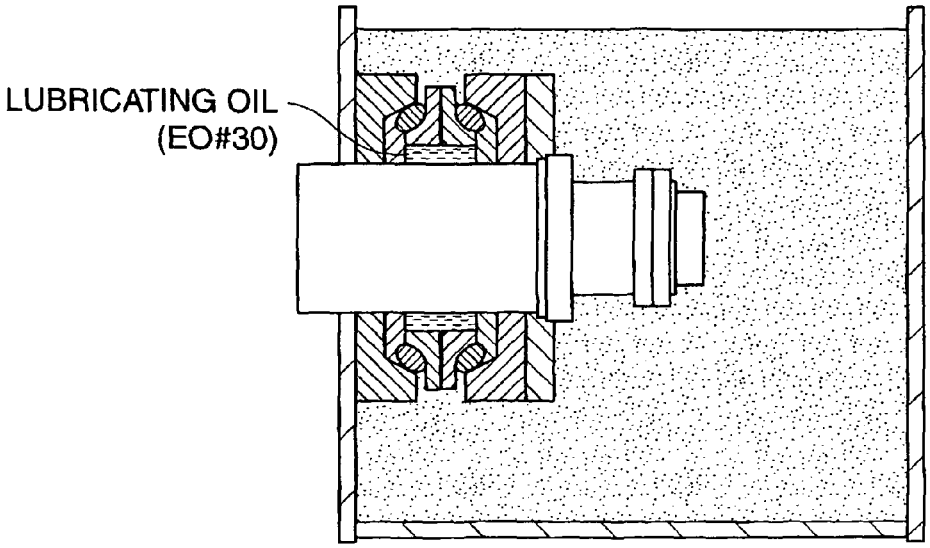
FIG. 6 is a drawing schematically showing a floating seal tester.

In this example, casting floating seal materials and casting comparative materials shown in Table 1 were used. Each of the material was cast in a shell-shaped mold to prepare comparative fusil specimens. On the other hand, after being cast in a shell-shaped mold, each of materials was re-heated (graphitized) at 950° C. and then quenched to prepare fusil specimens. Then, each of the comparative fusil specimens and the fusil specimens were machined to have a floating seal shape, as shown in FIG. 5, and then lapping treatment was applied to a seal surface (shown in the figure) thereof. Then, seizing resistance of each of the seal surface of both specimens was measured by using a floating seal tester, as shown in FIG. 6.

TABLE 1

COMPOSITION (wt %) AND PV VALUE OF MATERIALS

| | | | | | | | | | | | | | As Cast 950° C. | |
|---|---|---|---|---|---|---|---|---|---|---|---|---|---|---|
| No. | C | Si | Mn | Ni | Cr | Mo | V | Co | W | P | Al | Cu | PV VALUE 1 | PV VALUE 2 |
| No. 1 | 3.79 | 1.05 | 0.88 | 2.05 | 0.97 | 0.01 | | | | 0.03 | | | 1.8 | 2.4 |
| No. 2 | 3.81 | 2.01 | 0.86 | 2.01 | 0.93 | 0.01 | | | | 0.03 | | | 2.8 | 3.6 |
| No. 3 | 2.21 | 1.02 | 1.11 | 2.36 | 0.74 | | 0.51 | | | | | | 2.5 | 3.1 |
| No. 4 | 3.71 | 2.12 | 1.55 | 1.02 | 0.32 | | 2.51 | | | 0.02 | | | 3.3 | 3.9 |
| No. 5 | 3.63 | 2.99 | 1.08 | 4.01 | 1.03 | | 0 | | | | | | 3.9 | 4.6 |
| No. 6 | 3.78 | 3.01 | 0.85 | 3.91 | 1.01 | | 0.49 | | | | | | 4.1 | 4.9 |
| No. 7 | 2.95 | 3.65 | 2.02 | 2.03 | 0.91 | 0.02 | | | | 0.03 | | | 4.2 | 5.0 |
| No. 8 | 3.77 | 2.63 | 2.01 | 2.20 | 0.59 | 0.14 | 4.11 | | | 0.04 | | | 3.6 | 5.4 |
| No. 9 | 3.64 | 1.53 | 1.89 | 2.01 | 0.72 | | | | | 1.22 | | | 2.7 | 3.2 |
| No. 10 | 3.68 | 1.51 | 1.91 | 2.1 | 0.31 | 1.56 | | | | 0.02 | | | 2.5 | 3.3 |
| No. 11 | 3.52 | 2.01 | 0.81 | 2.02 | 0.51 | 0 | | | | 0.01 | | 4.91 | 2.5 | 3.6 |
| No. 12 | 3.35 | 2.66 | 0.77 | 2.29 | 1.03 | 0.16 | | | | 0.02 | | 9.70 | 3.4 | 4.2 |
| No. 13 | 3.31 | 1.51 | 0.85 | 3.98 | 1.05 | 0.16 | | | | 0.03 | 2.05 | 9.50 | 3.8 | 4.7 |
| No. 14 | 3.65 | 1.01 | 1.55 | 4.52 | 1.04 | 0.16 | | | | 0.02 | 3.51 | | 3.7 | 5.3 |
| CHILLED CAST IRON | 3.53 | 0.88 | 0.62 | 0.05 | 0.01 | 0.01 | | | | 0.11 | | 1.65 | 1.4 | 2.1 |
| Nihard | 3.12 | 0.96 | 0.47 | 4.22 | 3.17 | 0.01 | | | | 0.02 | | | 2.1 | 3.2 |
| $FC_{15}Cr_3Mo$ | 3.56 | 1.58 | 0.59 | 2.21 | 15.5 | 2.31 | 0.44 | | | | | | | 1.8 |
| $FC_9Cr_6Mo$ | 3.20 | 1.22 | 0.51 | 1.70 | 9.20 | 6.10 | 2.13 | 4.98 | 4.92 | | | | | 2.5 |

The floating seal tester used a floating seal member, in which each of the prepared fusil floating seal specimens was used as a pair of seal rings with the seal surfaces contacted each other. And, an O-ring which pressed one of the seal ring was rotated around a central axis of the seal rings with respect to a fixed O-ring which pressed another seal ring with applying load. The seizing resistance was evaluated by using a PV value. The PV value was obtained by product of P (pressure) and V (revolution rate) when seizing resistance rapidly increased while changing a rotating rate (a revolution rate V) under a condition in which press load between the seal surfaces was kept at 63 kgf (press pressure P was 2 kg/cm, the press pressure was a load per a seal surface length) to enclose engine oil (EO#30). The results are shown in columns of "PV value 1" and "PV value 2" in the table 1. The "PV value 1" shows a PV value of the comparative fusil specimens, in which the casting floating seal materials and the casting comparative floating seal materials were cast only. On the other hand, the "PV value 2" shows a PV value of the fusil specimens, in which the casting floating seal materials and the casting comparative floating seal materials were re-heated (graphitized) at 950° C. after casting, and then quenched. In addition, a solid soluble concentration of carbon in a martensite parent phase, a dispersive power of cementite, a concentration of alloy element in a parent phase and a concentration of alloy element in cementite of chilled cast iron, which are calculated by using a distribution coefficient of each metal element, are shown in Table 2.

TABLE 2

| | | | COMPOSITION (CONCENTRATION OF ALLOY ELEMENT et. al OF MATERIALS) | | | | | | | | | | | | | |
|---|---|---|---|---|---|---|---|---|---|---|---|---|---|---|---|---|
| | SOLID SOLUBLE | | γ KM. DISTRIBUTION COEFFICIENT OF ALLOY ELEMENT COMPOSITION (wt %) OF ALLOY ELEMENT IN MARTENSITE γ KM = | | | | | | | | | As Cast 950° C. COMPOSITION (wt %) OF ALLOY ELEMENT | | | | DEGREE OF GRAPHI- |
| | CARBON | VOLUME | 0 | 1.9 | 0.3 | 4. | 2.3 | 6. | 0 | 0 | 0 | IN CEMENTITE | | | | TIZA- |
| No. | (%) | OF θ (%) | Si | Mn | Ni | Cr | Mo | V | P | Al | Cu | Mn | Ni | Cr | Mo | TION |
| No. 1 | 0.56 | 0.48 | 2.0 | 0.62 | 3.08 | 0.40 | 0.01 | 0.00 | 0.06 | 0.0 | 0.0 | 1.17 | 0.92 | 1.59 | 0.01 | 1.85 |
| No. 2 | 0.36 | 0.52 | 4.0 | 0.59 | 3.08 | 0.37 | 0.01 | 0.00 | 0.06 | 0.0 | 0.0 | 1.13 | 0.92 | 1.50 | 0.01 | 1.72 |
| No. 3 | 0.62 | 0.22 | 1.3 | 0.92 | 2.80 | 0.44 | 0.00 | — | 0.00 | 0.0 | 0.0 | 1.76 | 0.84 | 1.78 | 0.00 | 2.69 |
| No. 4 | 0.43 | 0.42 | 3.5 | 1.14 | 1.41 | 0.15 | 0.00 | — | 0.03 | 0.0 | 0.0 | 2.17 | 0.42 | 0.58 | 0.00 | 2.33 |
| No. 5 | 0.18 | 0.52 | 5.8 | 0.75 | 6.07 | 0.42 | 0.00 | — | 0.00 | 0.0 | 0.0 | 1.43 | 1.82 | 1.68 | 0.00 | 1.29 |
| No. 6 | 0.17 | 0.53 | 5.9 | 0.59 | 5.97 | 0.41 | 0.00 | — | 0.00 | 0.0 | 0.0 | 1.12 | 1.79 | 1.63 | 0.00 | 0.96 |
| No. 7 | 0.16 | 0.42 | 6.0 | 1.49 | 2.79 | 0.42 | 0.01 | — | 0.05 | 0.0 | 0.0 | 2.84 | 0.84 | 1.68 | 0.03 | 3.71 |
| No. 8 | 0.35 | 0.39 | 4.2 | 1.51 | 2.97 | 0.28 | 0.09 | — | 0.06 | 0.0 | 0.0 | 2.86 | 0.89 | 1.12 | 0.22 | 3.31 |
| No. 9 | 0.49 | 0.47 | 2.8 | 1.34 | 2.96 | 0.30 | 0.00 | — | 0.30 | 0.0 | 0.0 | 2.54 | 0.89 | 1.21 | 0.00 | 2.86 |
| No. 10 | 0.51 | 0.48 | 2.8 | 1.35 | 3.09 | 0.13 | 0.98 | — | 0.04 | 0.0 | 0.0 | 2.57 | 0.93 | 0.52 | 2.25 | 4.41 |
| No. 11 | 0.42 | 0.47 | 3.6 | 0.58 | 2.94 | 0.22 | 0.00 | — | 0.02 | 0.0 | 8.9 | 1.10 | 0.88 | 0.87 | 0.00 | 1.09 |
| No. 12 | 0.28 | 0.46 | 4.7 | 0.55 | 3.30 | 0.45 | 0.10 | — | 0.04 | 0.0 | 17.2 | 1.05 | 0.99 | 1.78 | 0.23 | 2.08 |
| No. 13 | 0.50 | 0.42 | 2.6 | 0.62 | 5.61 | 0.47 | 0.10 | — | 0.05 | 3.5 | 16.2 | 1.18 | 1.68 | 1.87 | 0.24 | 1.60 |
| No. 14 | 0.57 | 0.46 | 1.9 | 1.10 | 6.65 | 0.44 | 0.10 | — | 0.04 | 6.5 | 0.0 | 2.09 | 2.00 | 1.75 | 0.23 | 2.07 |
| CHILLED CAST IRON | 0.65 | 0.43 | 1.5 | 0.45 | 0.07 | 0.00 | 0.01 | — | 0.19 | 0.0 | 2.9 | 0.85 | 0.02 | 0.02 | 0.01 | 0.86 |
| Nihard | 0.50 | 0.39 | 1.6 | 0.34 | 5.92 | 1.42 | 0.01 | — | 0.03 | 0.0 | 0.0 | 0.65 | 1.78 | 5.69 | 0.02 | 4.58 |
| $FC_{15}Cr_3Mo$ | | | | | | | | — | | | | | | | | |
| $FC_9Cr_6Mo$ | | | | | | | | — | | | | | | | | |

In the Table 2, No. 1 and No. 2 are alloy elements related Ni-hard chilled cast iron of the casting comparative materials. As compared a chilled cast iron and a Ni-hard cast iron of the comparative materials with No. 1 and No. 2, it is found that increasing an amount of Si decreases a solid soluble concentration of carbon with a martensite parent phase, whereby seizing resistance is improved. And, it is also fount that graphite which is dispersed and precipitated by the heat treatment (a heating temperature of 950° C. and a heating period of one hour) improves seizing resistance of the seal surface. FIG. 4A and FIG. 4B are photographs showing typical structures of a Ni-hard cast iron. From the figure, it is found that fine graphite particles having an average grain size of about 5 μm, which does not cause leakage of oil on the seal surface and evenly dispersed eutectic cementite particles are dispersed. However, remarkably decreasing eutectic cementite occurs, resulting in lack of abrasion resistance. Accordingly, such Ni-hard cast irons are suitable for a seal member required smaller abrasion resistance to earth and sand.

No. 3 and No. 4 are standards containing MC-type carbide ($V_4C_3$) of V dispersed therein with respect to No. 1 and No. 2 on the point of improvement in abrasion resistance. It is found that dispersing $V_4C_3$ carbide improves seizing resistance and abrasion resistance. And, it is observed that graphite is precipitated by graphitization, as a result, seizing resistance is improved by dispersion of graphite particles. Accordingly, they are suitable for a floating seal material required seizing resistance. Thus, it is also preferable to add an alloy element such as Ti, Zr, Nb and the like, which causes precipitation and dispersion of MC-type carbide, substitute for V. Especially, Ti is more preferable since it does not prevent graphitization.

No. 5, No. 6, No. 7 and No. 8 are materials in which an addition amount of Si is increased so as to have a concentration of Si in a martensite parent phase of 5 wt % or more in order to demonstrate an order-disorder transformation of $Fe_3Si$, and further to disperse $V_4C_3$ carbide therein. It is found that floating seal materials excellent in seizing resistance and abrasion resistance are obtained. In No. 8, to which V is added in a high density to disperse a large amount of $V_4C_3$, since a large amount of retained austenite remains by increasing an addition amount of Mn, whereby conformability of the seal surface is improved, therefore seizing resistance is more improved.

No. 9 and No. 10 are materials to which an increased amount of Mn is added so as to increase an amount of retained austenite in a martensite parent phase with the eutectic cementite, eutectic cementite and graphite particles dispersed therein, whereby tempering-softening resistance is heightened, in addition to an effect in which $Fe_3P$ phosphide are dispersed and an addition of Mo to the martensite parent phase. From the result, seizing resistance higher than that of the casting comparative material is obtained. And, dispersing sulphide substitute for phosphide also improves seizing resistance.

No. 11 and No. 12 are standards in order to confirm an effect of dispersion of Cu alloy phase. Increasing a dispersion amount of Cu alloy phase improves seizing resistance. Especially, No. 13, in which Cu alloy phase containing Al are dispersed, improves seizing resistance more than No. 11 and No. 12. Accordingly, seizing resistance may be improved by increasing an amount of Cu—Si—Al alloy phase.

No. 14 is a standard in which a $Fe_3Ai$ order-disorder transformation is heightened by adding of Al. Seizing resistance is improved, and age hardening is obtained by increasing of an addition amount of Ni, whereby excellent seizing resistance is demonstrated. And, it is effective for improving abrasion resistance to disperse MC-type carbide in these standards.

The present invention is not limited to any of the above-described constructions and embodiments, and various modifications of the present invention can be made without departing from the technical ideas.

What is claimed is:

1. A ferrous seal sliding part having a seal sliding surface, wherein said seal sliding surface has a martensite parent phase which forms a solid solution with carbon of 0.15 to 0.6 wt % and contains a first dispersion material of at least either cementite of 5 to 70% by volume or MC-type carbide of 0.1 to 10% by volume and a second dispersion material of at least either graphite of 1 to 15% by volume or Cu alloy phase of 1 to 20% by volume dispersed therein, with a total content of said first dispersion material and said second dispersion material being 5 to 70% by volume, wherein said seal sliding surface is formed by using a cast iron containing carbon of 2 to 5 wt %, Si of 0.5 to 6 wt %, Al of 1.0 to 6 wt % and Cr of 0.3 to 5 wt %, and one or more alloy element selected from the group consisting of V, Ti, Zr, Nb and Ta in a total amount of 2.51 to 5 wt %, and one or more alloy element selected from the group consisting of Mn of 0.1 to 5 wt %, Ni of 1 to 7 wt %, Cu of 1 to 10 wt %, Co of 2 to 15 wt %, Mo and Win a total amount of 0.5 to 2 wt %, P of 1.22 wt % or less, B, Ca and S, and a balance of Fe.

2. A ferrous seal sliding part according to claim 1, wherein said cast iron contains Si of 1.8 to 6 wt % so that a concentration of Si in said martensite parent phase will be 3 to 6.5 wt %.

3. A ferrous seal sliding part according to claim 1, wherein said cast iron contains Si of 1 to 3 wt % and so that an amount of Si in said martensite parent phase will be 2 to 4 wt % and a total amount of Mo and W in said martensite parent phase will be 0.5 to 1 wt %.

4. A ferrous seal sliding part according to claim 1, wherein said cast iron contains Si of 0.5 to 1.5 wt % and Cr of 0.9 to 5 wt % so that a total amount of Si and Cr in said martensite parent phase will be 2 to 4 wt % and an amount of Cr in said cementite will be 2.5 to 15 wt %.

5. A ferrous seal sliding part according to claim 1, wherein cementite is dispersed in said martensite parent phase in 15 to 50% by volume and granulated graphite having an average grain size of 15 μm or less is dispersed in said martensite parent phase in 1 to 10% by volume.

6. A ferrous seal sliding part according to claim 1, wherein cementite is dispersed in said martensite parent phase in 15 to 50% by volume and Cu alloy phase is dispersed in said martensite parent phase in 1 to 10% by volume.

7. A ferrous seal sliding part according to claim 1, wherein MC-type carbide is dispersed in said martensite parent phase in 2 to 10% by volume and graphite is dispersed in said martensite parent phase in 1 to 10% by volume.

8. A ferrous seal sliding part according to claim 1, wherein said cast iron contains Mn of 0.7 to 5 wt % so that an amount of Mn in said martensite parent phase will be 2 to 4 wt %, Ms temperature obtained by a following equation will be adjusted to 95 to 260° C., and retained austenite will remain in said martensite parent phase in 10 to 50% by volume:

$$Ms(K)=993-514\times\text{an amount of carbon(wt \%)}^{1/2}-20\times\text{an amount of Si (wt \%)}+23\times\text{an amount of Al (wt \%)}-46\times\text{an amount of Mn (wt \%)}-30\times\text{an amount of Cr (wt \%)}-21\times\text{an amount of Ni (wt \%)}-9\times\text{an amount of Cu (wt \%)}-20\times\text{an amount of Mo (wt \%)},$$

wherein said amount of carbon (wt %) means a content of carbon in said martensite parent phase; said amount of Si (wt %) means a content of Si in said martensite parent phase; said amount of Al (wt %) means a content of Al in said martensite parent phase; said amount of Mn (wt %) means a content of Mn in said martensite parent phase; said amount of Cr (wt %) means a content of Cr in said martensite parent phase; said amount of Ni (wt %) means a content of Ni in said martensite parent phase; said amount of Cu (wt %) means a content of Cu in said martensite parent phase; and said amount of Mo (wt %) means a content of Mo in said martensite parent phase.

9. A ferrous seal sliding part according to claim 1, wherein said cast iron contains Ni of 1 to 2.5 wt % so that as an amount of 0.5×Cu represents half of a real amount of Cu, a total addition amount of Mn, Ni and 0.5×Cu in said martensite parent phase is 2 to 7 wt %, Ms temperature obtained by a following equation will be adjusted to 95 to 260° C., and retained austenite will remain in said martensite parent phase in 10 to 50% by volume:

$$Ms(K)=993-514\times\text{an amount of carbon(wt \%)}^{1/2}-20\times\text{an amount of Si (wt \%)}+23\times\text{an amount of Al (wt \%)}-46\times\text{an amount of Mn (wt \%)}-30\times\text{an amount of Cr (wt \%)}-21\times\text{an amount of Ni (wt \%)}-9\times\text{an amount of Cu (wt \%)}-20\times\text{an amount of Mo (wt \%)},$$

wherein said amount of carbon (wt %) means a content of carbon in said martensite parent phase; said amount of Si (wt %) means a content of Si in said martensite parent phase; said amount of Al (wt %) means a content of Al in said martensite parent phase; said amount of Mn (wt %) means a content of Mn in said martensite parent phase; said amount of Cr (wt %) means a content of Cr in said martensite parent phase; said amount of Ni (wt %) means a content of Ni in said martensite parent phase; said amount of Cu (wt %) means a content of Cu in said martensite parent phase; and said amount of Mo (wt %) means a content of Mo in said martensite parent phase.

10. A ferrous seal sliding part according to claim 1, wherein an amount of Al in said martensite parent phase will be 1 to 12 wt %.

11. A ferrous seal sliding part according to claim 1, wherein said cast iron contains at least one of MC-type carbide, nitride and carbonitride of said alloy element selected from the group consisting of V, Ti, Zr, Nb and Ta mainly dispersed in said martensite parent phase at 2 to 10% by volume.

12. A ferrous seal sliding part according to claim 1, wherein said martensite parent phase contains at least either phosphide of at least any one of iron, V and Ti, or sulphide of at least either Mn or Ti dispersed therein in a total content of 0.2 to 5% by volume.

13. A ferrous seal sliding part according to claim 1, wherein said seal ferrous seal sliding part is made by casting using said cast iron.

14. A producing method of a ferrous seal sliding part having a step for casting a cast iron containing carbon of 2 to 5 wt %, Si of 0.5 to 6 wt %, Al of 1.0 to 6 wt % and Cr of 0.3 to 5 wt % and one or more alloy element selected from the group consisting of V, Ti, Zr, Nb and Ta in a total amount of 2.51 to 5 wt %, and one or more alloy element selected from the group consisting of Mn of 0.1 to 5 wt %, Ni of 1 to 7 wt %, Cu of 1 to 10 wt %, Co of 2 to 15 wt %, Mo and W in a total amount of 0.5 to 2 wt %, P of 1.22 wt % or less, B, Ca and S, and a balance of Fe, wherein said seal sliding part has a martensite parent phase which forms a solid solution with carbon of 0.15 to 0.6 wt % and contains a first dispersion material of at least either cementite of 5 to 70% by volume or MC-type carbide of 0.1 to 10% by volume and a second dispersion material of at least either graphite of 1 to 15% by volume or Cu alloy phase of 1 to 20% by volume dispersed therein, with a total content of said first dispersion material and said second dispersion material being 5 to 70% by volume.

15. A producing method of a ferrous seal sliding part according to claim 14, wherein said casting step is for casting said cast iron by a centrifugal method, using a mold which is heated to Ms temperature or more of a parent phase of said cast iron, and quenching said cast iron after releasing from said mold.

16. A producing method of a ferrous seal sliding part according to claim 14, wherein, after said casting step, a step for re-heating said cast iron at A1 transformation temperature or more of said cast iron and then graphitizing is carried out before said quenching step.

* * * * *